US007290991B2

(12) United States Patent
Staley et al.

(10) Patent No.: US 7,290,991 B2
(45) Date of Patent: Nov. 6, 2007

(54) DUAL OIL SUPPLY PUMP

(75) Inventors: David R. Staley, Flushing, MI (US); Brian D. White, Washington, MI (US)

(73) Assignee: General Motors Corporation, Detroit, MI (US)

( * ) Notice: Subject to any disclaimer, the term of this patent is extended or adjusted under 35 U.S.C. 154(b) by 598 days.

(21) Appl. No.: 10/781,430

(22) Filed: Feb. 18, 2004

(65) Prior Publication Data

US 2005/0180870 A1 Aug. 18, 2005

(51) Int. Cl.
*F04B 49/00* (2006.01)

(52) U.S. Cl. ..... 417/286; 123/196 R; 417/307; 417/372

(58) Field of Classification Search ..... 417/440, 417/269, 372, 286, 307; 123/373, 90.16, 123/192.2, 196 R
See application file for complete search history.

(56) References Cited

U.S. PATENT DOCUMENTS 4,538,966 A * 9/1985 Nikaido ..... 417/288
5,901,536 A * 5/1999 Kallevig ..... 56/10.9
6,082,321 A * 7/2000 Kopec ..... 123/196 R
6,601,557 B1 * 8/2003 Hayman et al. ..... 123/192.2
6,810,845 B1 * 11/2004 Plenzler et al. ..... 123/90.33
6,955,045 B2 * 10/2005 Evans ..... 417/270

* cited by examiner

*Primary Examiner*—Anthony D. Stashick
*Assistant Examiner*—Peter J Bertheaud

(57) ABSTRACT

An automotive engine oil pump assembly having first and second pump mechanisms contained within a common housing. A shaft rotatably supported in the housing drives the pump mechanisms in a conventional manner. The pump mechanisms are offset in phase to reduce flow pulsations through the housing and limit pump noise and vibration. The first pump mechanism communicates with a common inlet and first outlet of the housing. The second pump mechanism communicates with the common inlet and second outlet of the housing. A common reservoir connected to inlets of the first and second oil pump mechanisms provides a supplemental oil source to balance oil pressures at the pump inlets to prevent pump cavitation and further reduce pump noise and vibration.

12 Claims, 2 Drawing Sheets

DUAL OIL SUPPLY PUMP

TECHNICAL FIELD

This invention relates to engine oil pumps and, more particularly, to dual oil supply pumps for use in automotive lubrication applications.

BACKGROUND OF THE INVENTION

Dual oil supply pumps are used primarily in conjunction with industrial hydraulic applications. However, dual oil supply pumps have also been used in automotive applications. One such automotive dual oil supply pump utilizes two individual oil pumps each having a discrete housing. While this pump meets engine oil flow requirements, its packaging requires a large amount of volume.

Dual oil supply pumps which are contained within a common housing to reduce packaging volume may under high flow rates experience flow imbalance between the pumps. Specifically, when one pump draws a greater volume than its counterpart does, the pump drawing the greater amount of oil can starve the other pump. Additionally, pumps contained within a common housing usually operate on the same frequency resulting in flow pulsations that are translated to pressure fluctuations though the pump, which may cause undesirable pump vibration and noise.

SUMMARY OF THE INVENTION

The present invention provides an oil pump assembly having first and second pump mechanisms contained within a common housing to maximize packaging efficiency of the pump. The pump assembly also provides adequate inlet oil flow to each of the pump mechanisms to prevent flow imbalance and cavitation during operation. Furthermore, the pump mechanisms are offset in phase to reduce flow pulsations through the housing to reduce pump noise and vibration.

The pump assembly includes a housing defining an interior cavity, a common inlet, and first and second outlets. A shaft having an external drive is rotatably supported in the housing and extends through first and second pump mechanisms, which are rotatably connected with the shaft for driving the pump mechanisms in a conventional manner. The first pump mechanism communicates with the common inlet and the first outlet of the housing. The second pump mechanism communicates with the common inlet and the second outlet of the housing. A first pressure relief valve connected to receive oil from the first pump mechanism limits oil pressure to the first outlet by discharging excess oil flow to a common reservoir. A second pressure relief valve connected to receive oil from the second pump mechanism limits oil pressure to the second outlet by discharging excess oil flow to the common reservoir. The common reservoir is connected to the first and second oil pump mechanisms to provide a supplemental inlet oil source to balance pressures and flow demand at the pump inlets to prevent pump cavitation.

These and other features and advantages of the invention will be more fully understood from the following description of certain specific embodiments of the invention taken together with the accompanying drawings.

DESCRIPTION OF THE PREFERRED EMBODIMENT

Figure 1:
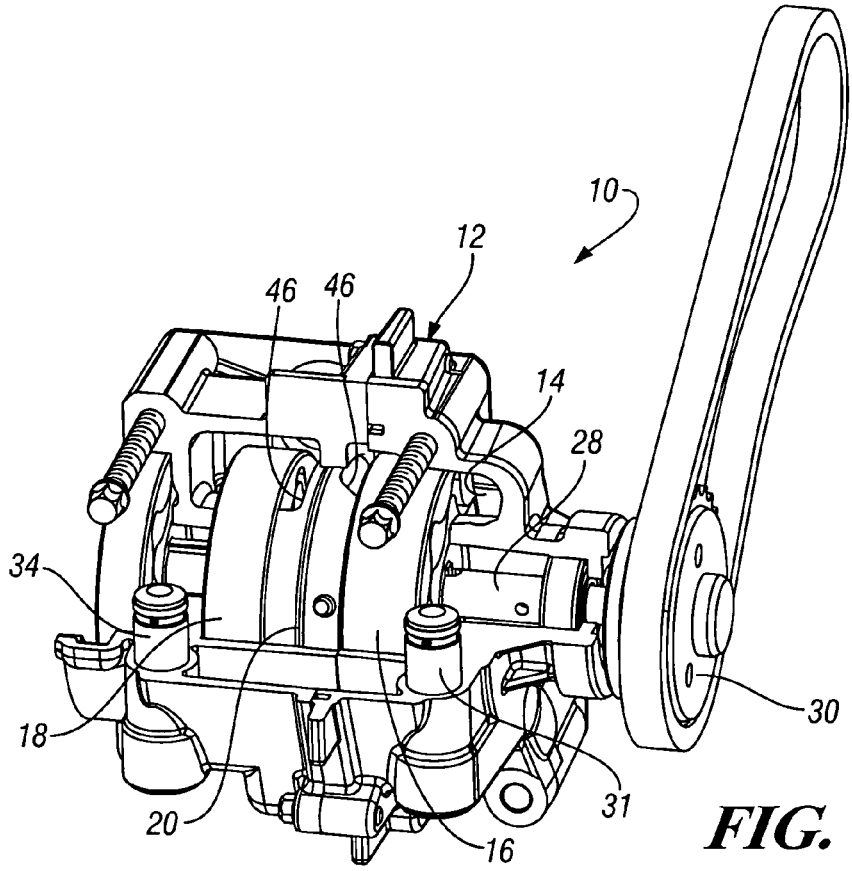
FIG. 1 is a pictorial view partially broken away to show interior and exterior features of an automotive oil pump assembly according to the present invention.
Figure 2:
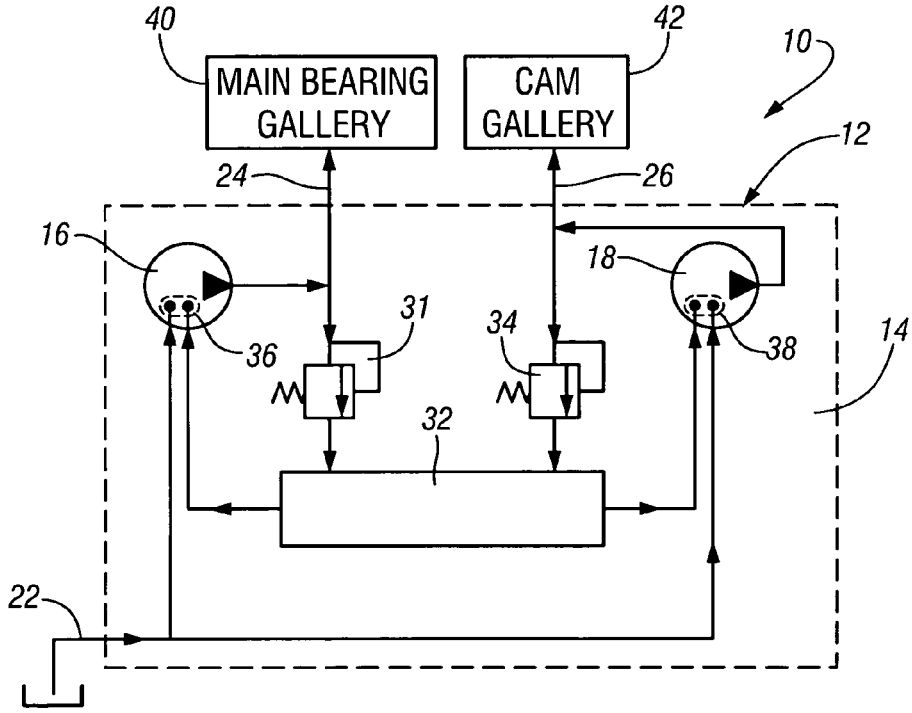
FIG. 2 is a flow diagram of the oil pump assembly of FIG. 1.

Referring now to FIGS. 1 and 2 of the drawings in detail, numeral 10 generally indicates an engine oil pump assembly. The pump assembly 10 includes a housing 12 defining an interior cavity 14 containing first and second pump mechanisms 16, 18 and a central port plate 20. The housing includes a common inlet 22 for feeding both pump mechanisms 16, 18, and first and second outlets 24, 26 connected with the separate pump mechanisms 16, 18. A shaft 28 having an external drive member 30 extends longitudinally through the housing 12 and drives both pump mechanisms 16, 18 at the same rotational velocity. Preferably, the pump mechanisms 16, 18 are positive displacement pumps such as gerotors. If desired, the first pump mechanism 16 may be advanced on the shaft 28 relative to the second pump 18 so that the pumps operate out of phase to reduce pulsation and vibration of the oil pump assembly 10. In addition, the pump mechanisms 16, 18 may have different displacements or flow rates if desired.

A first pressure relief valve 31 is connected to receive oil from the first pump mechanism 16 to limit outlet pressure at first outlet 24 by discharging excess oil flow to a common internal reservoir 32. A second pressure relief valve 34 is connected to receive oil from the second pump mechanism 18 to limit outlet pressure at the second outlet 26 by also discharging excess oil flow to the common reservoir 32. The common reservoir 32 is connected to the inlets of both the first and second oil pump mechanisms 16, 18 to provide recirculated oil to inlets 36, 38 of both pump mechanisms.

A chain or accessory belt connected to the external drive member 30 rotates the driveshaft 28 to operate the pump assembly 10. As the driveshaft 28 rotates, the first and second pump mechanisms 16, 18 draw in oil through the inlet 22 of the housing 12 and discharge the oil toward their respective outlets 24, 26. As the oil pump outlet pressures increase at outlets 24, 26 during engine operation, the pressure relief valves 31, 34 open at their respective pressure control settings. The valves direct excess oil flow to the common reservoir 32 and thereby maintain prescribed oil pressures at the outlets and in connecting main bearing and cam galleries 40, 42 of the engine. The oil contained within the common reservoir 32 is recirculated to both of the pump inlets 36, 38 and thus tends to equalize the inlet oil pressures of both pump mechanisms. This recirculation of excess oil also limits the amount of oil drawn into the pumps through the common inlet 22. Both results tend to maximize the pump inlet pressures and limit the likelihood of pump cavitation.

In the exemplary embodiment of FIG. 1, the first pump mechanism 16 discharges a flow of oil greater than that needed to lubricate the main bearing gallery 40 at the required pressure with excess flow diverted to the common reservoir 32 by the first pressure relief valve 31. The second pump mechanism 18 discharges a flow of oil more than needed to lubricate the cam gallery 42 at a required greater pressure with the excess oil pressure diverted to the common reservoir 32. The excess flow diverted to the reservoir 32 is recirculated through both of the pump mechanisms so that the oil drawn in through the housing common inlet 22 is equal to that delivered to the oil galleries exclusive of the recirculated excess pump flow. If desired, oil flow from one of the pump mechanisms may be substantially increased in relation to the other pump mechanism to aid the lower producing pump mechanism with additional supplemental oil from the common reservoir.

Figure 3:
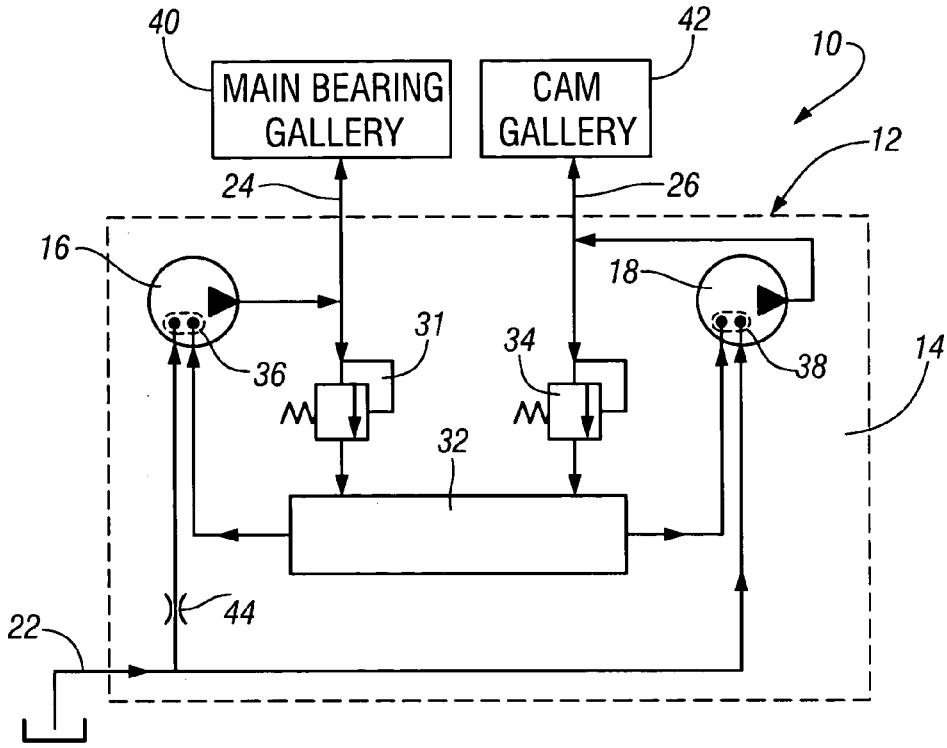
FIG. 3 is a flow diagram of an oil pump assembly similar to the oil pump assembly of FIG. 1.

In an alternative embodiment, shown in FIG. 3, a housing restriction 44 between the common inlet 22 and the first pump mechanism 16 limits main inlet oil flow to the first pump mechanism. In order to overcome the restriction of oil supplied to the first pump mechanism, the second pump mechanism 18 may generate a greater oil flow to provide additional excess oil flow to the common reservoir 32 to supplement inlet flow to the first pump mechanism 16. The supplemental oil directed from the second pump mechanism 18 to the first pump mechanism 16 tends to balance the inlet pressures of both pump mechanisms and thus avoids cavitation at the inlet of the first pump mechanism due to the restriction 44.

Figure 4:
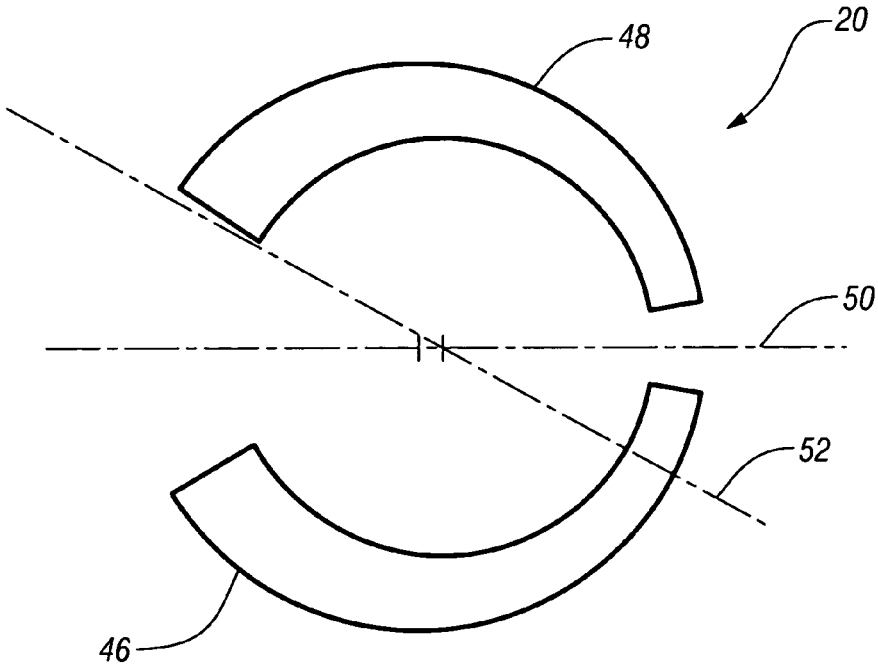
FIG. 4 is a diagram illustrating the porting arrangements of the pump mechanisms of FIG. 1.

FIG. 4 shows, in the port plate 20, the arrangement of the inlet port 46 and exhaust port 48 for the first pump mechanism 16. The neutral axis 50 of these ports is also shown as is the neutral axis 52 of the ports, not shown, of the second pump mechanism 18. As shown, the axis 52 is staggered from the position of the axis 50 to indicate that the ports of the second pump mechanism 18 are angularly indexed relative to the ports of the first pump mechanism 16. Preferably, the angle of index is equal to one-half the angular spacing between the meshing of the adjacent lobes on the pump rotor, not shown. This causes the discharge of oil from the dual pump mechanisms to occur out of phase, thereby increasing the frequency while reducing the magnitude of pulsations, or flow ripples, caused by the successive discharge events. Since the pressure relief valves 31, 34 are sympathetic to flow ripple, staggering the pump mechanisms 16, 18 helps to stabilize the movement of the relief valves, resulting in less pump noise. In addition, supplemental oil directed out of phase between the pump mechanisms through the common reservoir 32 tends to balance the oil pressure at the inlets of the pumps to further reduce flow pulsations created by the operation of the pump mechanisms.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. An engine oil pump assembly comprising:

a housing defining an interior cavity and including a common inlet for receiving oil from an external reservoir, first and second outlets for supplying pressurized oil for lubrication of separate external mechanisms with return to the external reservoir, and a common internal reservoir disposed within the housing;

a shaft extending longitudinally though the housing and having an external drive;

a first pump mechanism driven by the shaft and communicating with the common inlet and the first outlet of the housing;

a second pump mechanism driven by the shaft and communicating with the common inlet and the second outlet of the housing;

a first pressure relief valve connected to receive oil from the first pump mechanism and to limit pressure to the first outlet by discharging excess oil flow to the common internal reservoir;

a second pressure relief valve connected to receive oil from the second pump mechanism and to limit pressure to the second outlet by discharging excess oil flow to the common internal reservoir; and the common internal reservoir connected to supply supplemental inlet oil to the first and second pump mechanisms.

2. An oil pump assembly as in claim 1 wherein the first pump mechanism is advanced in relation to the second pump mechanism to reduce pulsation.

3. An oil pump assembly as in claim 1 wherein oil flow between the common inlet of the housing and the first pump mechanism is restricted.

4. An oil pump assembly as in claim 3 wherein the common internal reservoir supplies additional oil flow to the first pump mechanism.

5. An oil pump assembly as in claim 3 wherein the common internal reservoir supplies additional oil flow to the second pump mechanism.

6. An oil pump assembly as in claim 1 wherein the oil pump mechanisms are gerotors.

7. An oil pump assembly as in claim 1 wherein the first and second outlets each discharge oil to an independent oil circuit.

8. An oil pump assembly as in claim 7 wherein the first outlet supplies oil to an engine main bearing gallery.

9. An oil pump assembly as in claim 7 wherein the second outlet supplies oil to an engine cam gallery.

10. A method of operating a dual oil supply pump assembly, comprising the steps of:

providing an oil pump assembly including a housing defining an interior cavity and including a common inlet for receiving oil from an external reservoir, first and second outlets for supplying pressurized oil for lubrication of separate external mechanisms with return to the external reservoir, and a common internal reservoir disposed within the housing, a shaft extending longitudinally through the housing and having an external drive, a first pump mechanism driven by the shaft and communicating with the common inlet and the first outlet of the housing, a second pump mechanism driven by the shaft and communicating with the common inlet and the second outlet of the housing, a first pressure relief valve connected to receive oil from the first pump mechanism and to limit pressure to the first outlet by discharging excess oil flow to the common internal reservoir, a second pressure relief valve connected to receive oil from the second pump mechanism and to limit pressure to the second outlet by discharging excess oil flow to the common internal reservoir and the common internal reservoir connected to supply supplemental inlet oil to the first and second pump mechanisms;

rotating the shaft to operate the first and second pump mechanisms;

drawing oil through the common inlet with the first pump mechanism;

drawing oil through the common inlet with the second pump mechanism;

supplying pressurized oil to the first outlet and to the first pressure relief valve with the first pump mechanism, thereby allowing the first pressure relief valve to control oil pressure at the first outlet by discharging a portion of the oil to the common internal reservoir;

supplying pressurized oil to the second outlet and to the second pressure relief valve with the second pump mechanism, thereby allowing the second pressure relief valve to control oil pressure at the second outlet by discharging a portion of the oil to the common internal reservoir; and supplying the pump mechanisms with supplemental inlet oil from the common internal reservoir.

11. A method as in claim 10 including reducing flow pulsations through the pump assembly by advancing the phase of the first pump mechanism in relation to that of the second pump mechanism.

12. A method as in claim 10 including providing increased flow from one of the pump mechanisms to supply additional oil to the common reservoir to provide additional supplemental inlet oil for the other pump mechanism.

* * * * *